US006836249B2

(12) United States Patent
Kenoun et al.

(10) Patent No.: US 6,836,249 B2
(45) Date of Patent: Dec. 28, 2004

(54) RECONFIGURABLE ANTENNA FOR MULTIBAND OPERATION

(75) Inventors: Robert Kenoun, Palatine, IL (US); Narendra Pulimi, Cary, IL (US)

(73) Assignee: Motorola, Inc., Schaumburg, IL (US)

( * ) Notice: Subject to any disclaimer, the term of this patent is extended or adjusted under 35 U.S.C. 154(b) by 239 days.

(21) Appl. No.: 10/277,593

(22) Filed: Oct. 22, 2002

(65) Prior Publication Data

US 2004/0075611 A1 Apr. 22, 2004

(51) Int. Cl.[7] ..... H01Q 1/38
(52) U.S. Cl. ..... 343/700 MS; 343/702; 343/850
(58) Field of Search ..... 343/700 MS, 702, 343/745, 829, 846, 850

(56) References Cited

U.S. PATENT DOCUMENTS 6,326,921 B1 * 12/2001 Egorov et al. ..... 343/700 MS
6,476,769 B1 * 11/2002 Lehtola ..... 343/702
6,573,869 B2 * 6/2003 Moore ..... 343/702
6,650,295 B2 * 11/2003 Ollikainen et al. .. 343/700 MS

* cited by examiner

*Primary Examiner*—Shih-Chao Chen
(74) *Attorney, Agent, or Firm*—Matthew Loppnow

(57) ABSTRACT

An antenna assembly for a mobile communication device. The antenna assembly can include a RF connection feed point and a planar radiating element including a conductive area split by a nonconductive gap which divides the planar radiating element into a first arm having an end coupled to the RF connection feed point and a second arm having an end coupled to the RF connection feed point. The antenna assembly can also include a first connection point coupled to the opposite end of the first arm from the RF connection feed point, the first connection point being selectively coupled to an impedance.

23 Claims, 3 Drawing Sheets

RECONFIGURABLE ANTENNA FOR MULTIBAND OPERATION

BACKGROUND OF THE INVENTION

1. Field of Invention

The present invention is directed to multi-band antennas. In particular, the present application is directed to a planar inverted-F antenna with selectable frequency responses.

2. Description of Related Art

Presently, devices such as mobile communication devices utilize antennas such as planar inverted-F antennas (PIFAs) for the transmission and reception of radio frequency (RF) signals. These mobile communication devices require the capability to transmit in various frequency bands to be compatible with various systems. For example, such systems can operate at 800, 900, 1800, and 1900 MHz. Unfortunately, at best, current antennas used in mobile communication devices can only operate in limited frequency bands. For example, current PIFA antennas can only operate in a dual band and are incapable of operating for more than two frequency bands. Another problem exists in that present antennas for mobile communication devices have limited bandwidth of operation. A further problem exists in that increasing power to present antennas for improved performance results in specific absorption ratio problems.

Thus, there is a need for an antenna assembly that provides for multiple frequency operation over a wide bandwidth while reducing specific absorption ratio problems.

SUMMARY OF THE INVENTION

The invention provides an antenna assembly for a mobile communication device. The antenna assembly can include a RF connection feed point and a planar radiating element including a conductive area split by a nonconductive gap which divides the planar radiating element into a first arm having an end coupled to the RF connection feed point and a second arm having an end coupled to the RF connection feed point. The antenna assembly can also include a first connection point coupled to the opposite end of the first arm from the RF connection feed point, the first connection point being selectively coupled to an impedance.

According to another embodiment, the invention provides an antenna assembly for a mobile communication device, including a RF connection feed point, a first arm having an end coupled to the RF connection feed point, a second arm having an end coupled to the RF connection feed point, and tuning circuitry selectively coupled to the opposite end of the first arm from the RF connection point. The tuning circuitry can be a first connection point selectively coupled to a ground. The tuning circuitry can also be an impedance. The antenna assembly can also include means for selectively eliminating the effects of the second arm on the antenna assembly. The means for selectively eliminating can be an impedance coupled to the opposite end of the second arm from the RF connection point. Also, the means for selectively eliminating can be a second connection point coupled to the opposite end of the second arm from the RF connection point, the second connection point being selectively coupled to a ground.

The antenna assembly can also include a connection leg in close proximity to the RF connection feed point, the connection leg being selectively coupled to a ground. The second arm can be longer than the first arm or the first arm can be longer than the second arm. The first arm can include a section folded substantially perpendicular to the first arm along a length of the first arm. Also, the first arm can include a section folded substantially perpendicular to the first arm at the end of the first arm, wherein the tuning circuitry can be coupled to the section folded substantially perpendicular to the first arm. Furthermore, the second arm can include a section folded substantially perpendicular to the second arm at the end of the second arm.

Thus, the present invention solves numerous problems with present antennas and provides additional benefits that are apparent in the description below.

BRIEF DESCRIPTION OF THE DRAWINGS

The preferred embodiments of the present invention will be described with reference to the following figures, wherein like numerals designate like elements, and wherein.

DETAILED DESCRIPTION OF PREFERRED EMBODIMENTS

Figure 1:
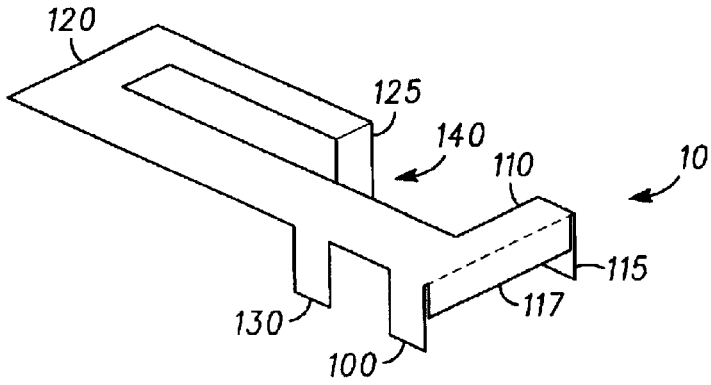
FIG. 1 is an exemplary illustration of an antenna assembly according to a first embodiment.

FIG. 1 is an exemplary illustration of an antenna assembly 10, such as a planar inverted-F antenna, according to a first embodiment. Such an antenna assembly 10 can be used in, for example, a mobile communication device. The antenna assembly 10 can include a RF connection feed point 100, a first arm 110, a first arm end 115, a folded section 117, a second arm 120, a second arm end 125, a connection leg 130, and a gap 140. The feed point 100, connection leg 130, and arm ends 115 and 125 may be bent ends, legs, attached legs, connection points, or the like. For example, the first arm end 115 may include a portion of the first arm 110 bent down to a connection point and the second arm end 125 may include a portion of the second arm 120 bent down to a connection point on a printed circuit board or elsewhere. The second arm 120 may be a long arm and the first arm 110 may be a short arm depending on frequencies to be transmitted and received. According to another embodiment, the second arm 120 may be a short arm and the first arm 110 may be a long arm. The first arm 110 and the second arm 120 may define a planar radiating element including a nonconductive gap 140. The folded section 117 may be located on the first arm 110 or the second arm 120. Additionally, the folded section 117 may be an attachment to an arm, a bent portion of an arm, a sidewall, or any other section useful for tuning an arm or an antenna for resonating in a desired band. The folded section 117 may be substantially perpendicular to an arm. For example, the folded section 117 may be folded at a substantially right angle, may curve down, or may be otherwise substantially perpendicular to an arm or to a ground plane.

The first arm 110 may extend from the feed point 100 to the first arm end 115. Thus, the feed point 100 is located at one end of the first arm 110 and the first arm end 115 is located at an opposite end of the first arm 110. Similarly, the second arm 120 may extend from the feed point 100 to the second arm end 125. Thus, the feed point 100 is located at one end of the second arm 120 and the second arm end 125 is located at an opposite end of the second arm 120. Such locations are not absolute and are thus, approximate. For example, the second arm end 125 may be located at the side of the second arm 120 at the opposite end of the second arm 120 from the feed point 100. Additionally, the ends of the arms may be folded substantially perpendicular to the arms. For example, the ends may be bent at an approximate 90-degree angle, may be curved down, may be attached at a right angle, or may be otherwise substantially perpendicular to the arm or a ground plane.

In operation, the first arm 110 may be a short arm that resonates in one frequency band and the second arm 120 may be a long arm that resonates in another frequency band. The first arm end 115, the second arm end 125, and the connection leg 130 can be grounded or ungrounded by switching techniques. According to another embodiment, the first arm end 115, the second arm end 125, and the connection leg 130 can be coupled to tuning impedances by switching techniques. Thus, the tuning and structure of the antenna assembly 10 can be altered by various switching techniques. In particular, by adjusting the impedances and/or grounding points located at the arm ends 115 and 125 and the connection leg 130, a single antenna assembly 10 can be used for radiating in a wider band in numerous frequency bands. For example, impedances can be used to compensate for the lengths of the legs 110 and 120. Thus, a single antenna can be used for at least quad-band operation. In a particular example, the bandwidth of the antenna assembly 10 is increased in high and low bands and the antenna assembly 10 is capable of radiating in all bands of 800/900 MHz, 1800/1900 MHz, and GPS frequency. Also, the antenna can be tuned by altering lengths and widths of the arms 110 and 120 and the size of the folded section 117 to operate in other frequencies.

For improved operation and tuning in given frequencies, a ground plane may be extended under the antenna assembly 10 in its length. This can further improve the return loss of the antenna assembly 10 Additional adjustments may be made, such as reducing the height and increasing the width of components of the antenna assembly 10 based on space and tuning requirements.

Figure 2:
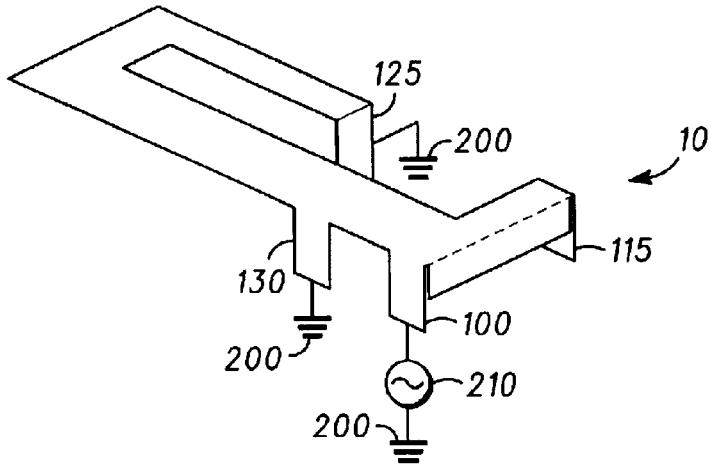
FIG. 2 is an exemplary illustration of an antenna assembly according to a second embodiment of high band mode operation.

FIG. 2 is an exemplary illustration of an antenna assembly 10 according to a second embodiment of high band mode operation. For example, the antenna assembly 10 may operate in a mode covering both 1800 and 1900 MHz. In high band mode operation, the first arm end 115 may float and the second arm end 125 and the connection leg 130 may be connected to a ground plane 200. Thus, the second arm 120 can join the first arm 110 to become a second resonator in the high band. Therefore, the two arms can both resonate in the high band and provide for a large bandwidth. For example, the antenna assembly 10 can cover not only 1800 and 1900 MHz, but also cover GPS frequency.

Figure 3:
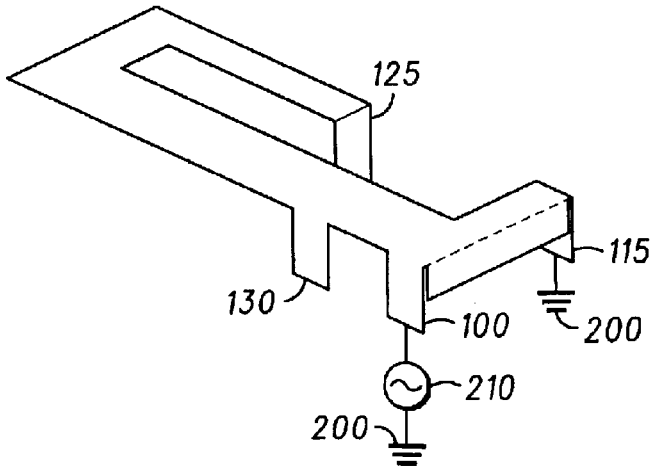
FIG. 3 is an exemplary illustration of an antenna assembly according to a third embodiment of low band mode operation.

FIG. 3 is an exemplary illustration of an antenna assembly 10 according to a third embodiment of low band mode operation. For example, the antenna assembly 10 may operate in a mode covering both 800 and 900 MHz. In low band mode operation, the first arm end 115 may be connected to a ground plane 200 and the second arm end 125 and the connection leg 130 may float. Thus, the first arm 110 may be disabled partially by making it look like high impedance at the feed point 100 looking into that arm. The second arm 120 then resonates as a micro strip line. Therefore, the bandwidth of operation of the antenna assembly 10 in the low band mode significantly increases.

Figure 4:
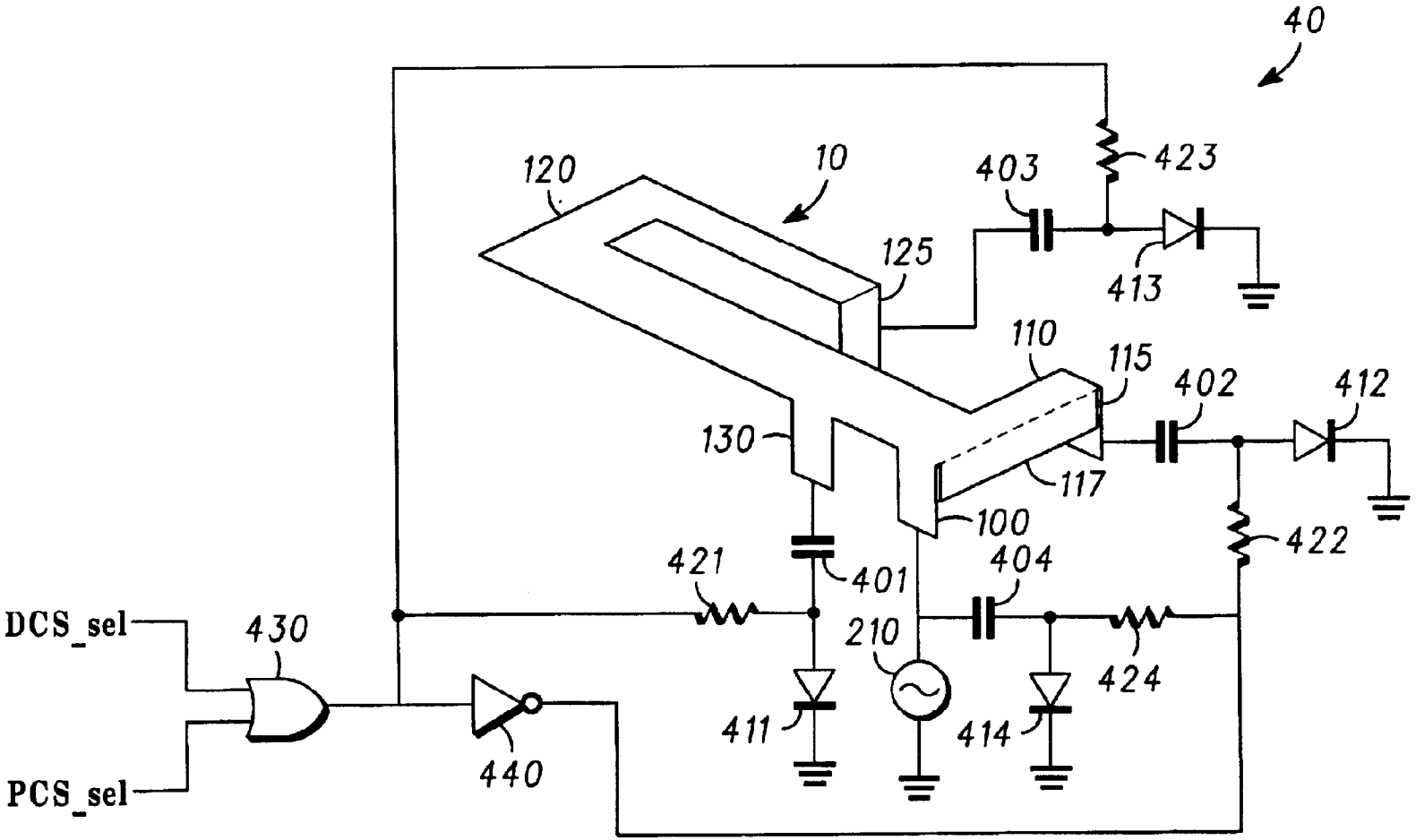
FIG. 4 is an exemplary illustration of an antenna assembly system according to a preferred embodiment.

FIG. 4 is an exemplary illustration of an antenna assembly connection switching system 40 according to a preferred embodiment. It is understood that other embodiments may be employed for switching the connections to the antenna assembly 10, such as a programmable logic gate array, processor switching, micro-electromechanical switches, or any other circuits or means for switching electrical and RF connections. The antenna assembly system 40 can include capacitors 401–404, diodes 411–414, resistors 421–424, an OR gate 430, and an inverter 440. The assembly system 40 is merely exemplary and may be designed in various ways. For example, the selection of logic devices may depend on the logic signals available from the logic circuits in selecting a particular band. As another example, XOR gates, AND gates, NAND gates, or other logic circuitry may be used depending on received signals and design choices. The present capacitors, diodes, and resistors can be selected for appropriate coupling and to resonate unwanted reactances. For example, the capacitors 401–403 may be over 100 pF and the resistances 421–423 may be over 1 k ohm.

In operation, the OR gate 430 may receive selection signals for selecting a mode of operation. According to one embodiment, the OR gate 430 may receive DCS and PCS selection lines. For example, logical ones and zeros may be sent to the inputs of the OR gate 430 to select specific modes of operation illustrated in the truth table in Table 1. In this case, when either of the selection lines is high, the operation can be for high band frequencies. When both selection lines are low, the operation can be for low band frequencies.

TABLE 1

| | Connection Leg 130 | Feed Point 100 | Second Arm End 125 | First Arm End 115 |
|---|---|---|---|---|
| 800/900 MHz | Float | Signal with match | Float | GND |
| 1800/1900 MHz | GND | Signal without match | GND | Float |

Also, Table 1 illustrates that the state of the legs in one mode of operation can be the reversal of the other. Thus, the other is a negation of the first mode. Therefore, if either DCS mode or PCS mode is selected for a high band 1800/1900 MHz mode of operation, a logical one will exist at the output of the OR gate. This logical one will turn on the diodes 411 and 413 based on well known electrical circuitry principles. In particular, the diodes 411 and 413 will be forward biased. Thus, the connection leg 130 and the second arm end 125 will be grounded. At the same time, a logical zero will exist at the output of the inverter 440 to turn off the diode 412. In particular, the diode 412 will be turned off. Therefore, the first arm end 115 will not be grounded. In this case, a matching component is not needed to turn off diode 414 to disable capacitor 404 because the capacitor 404 is a matching component for low band operation. For example, the truth table can change if the goal is to tune the antenna to perform without a matching circuit in the low band and with a matching circuit in the high band. Thus, the circuit may be altered accordingly. As further example, depending on intended use, a capacitance of 2.2 pF may be used for appropriately tuning the antenna assembly 10 in low band mode of operation. If neither DCS or PCS mode is selected, a logical zero will exist at the output of the OR gate 430 and a low band 800/900 MHz mode of operation will be enabled.

Thus, opposite components are grounded and not grounded as indicated in Table 1 above. In actual practice, the ground points of diodes 411 and 413 may be connected to the output of the inverter 440 as opposed to the ground to ensure the diodes are reverse biased and in off mode with certainty.

Figure 5:
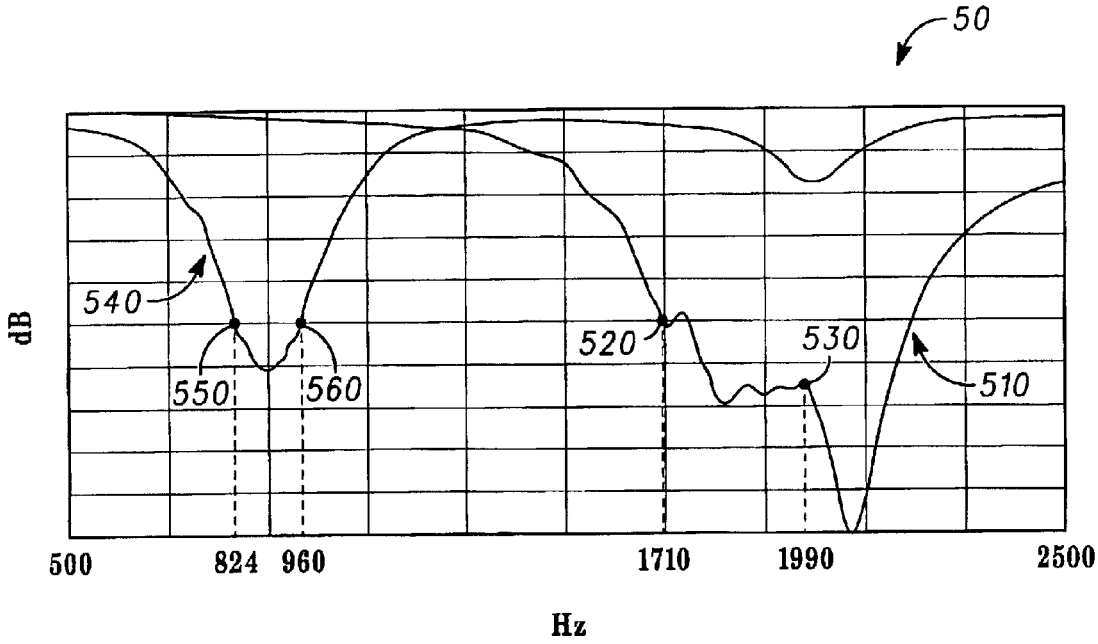
FIG. 5 is an exemplary graph of a frequency response of a specifically tuned antenna assembly.

FIG. 5 is an exemplary graph 50 of a frequency response of a specifically tuned antenna assembly 10. The graph 50 illustrates the response of the antenna assembly in a high band mode 510 and in a low band mode 540. For example, the high band mode 510 can include DCS frequencies of 1710–1880 Hz and PCS frequencies of 1850–1990 Hz. Thus, point 520 illustrates the performance at 1710 Hz and point 530 illustrates the performance at 1990 Hz. As another example, the low band mode 540 can include AMPS and TDMA frequencies of 824–894 Hz and EGSM frequencies of 880–960 Hz. Thus, point 550 illustrates the performance at 824 Hz and point 560 illustrates the performance at 960 Hz. Performance may vary according to the height of the antenna from a ground plane. For example, the present performance can be achieved for a ground plane 9.5 mm below the antenna. Well-known techniques of antenna tuning can be utilized to retune the antenna assembly 10 for other frequencies of operation.

While this invention has been described with specific embodiments thereof, it is evident that many alternatives, modifications, and variations will be apparent to those skilled in the art. For example, various components of the embodiments may be interchanged, added, or substituted in the other embodiments. Accordingly, the preferred embodiments of the invention as set forth herein are intended to be illustrative, not limiting. Various changes may be made without departing from the spirit and scope of the invention.

What is claimed is:

1. An antenna assembly for a mobile communication device, comprising:

a RF connection feed point;

a first arm having an end coupled to the RF connection feed point;

a second arm having an end coupled to the RF connection feed point; and tuning circuitry selectively coupled to the opposite end of the first arm from the RF connection point.

2. The antenna assembly according to claim 1, wherein the tuning circuitry comprises a first connection point coupled to a ground.

3. The antenna assembly according to claim 1, wherein the tuning circuitry comprises an impedance.

4. The antenna assembly according to claim 1, further comprising:

means for selectively eliminating the effects of the second arm on the antenna assembly.

5. The antenna assembly according to claim 4, wherein the means for selectively eliminating comprises an impedance coupled to the opposite end of the second arm from the RF connection point.

6. The antenna assembly according to claim 4, wherein the means for selectively eliminating comprises a second connection point coupled to the opposite end of the second arm from the RF connection point, the second connection point being selectively coupled to a ground.

7. The antenna assembly according to claim 1, further comprising:

a connection leg in close proximity to the RF connection feed point, the connection leg being selectively coupled to a ground.

8. The antenna assembly according to claim 1, wherein the second arm is longer than the first arm.

9. The antenna assembly according to claim 1, wherein the first arm is longer than the second arm.

10. The antenna assembly according to claim 1, wherein the first arm includes a section folded substantially perpendicular to the first arm along a length of the first arm.

11. The antenna assembly according to claim 1, wherein the first arm includes a section folded substantially perpendicular to the first arm at the end of the first arm, and wherein the tuning circuitry is coupled to the section folded substantially perpendicular to the first arm.

12. The antenna assembly according to claim 1, wherein the second arm includes a section folded substantially perpendicular to the second arm at the end of the second arm.

13. The antenna assembly according to claim 1, wherein the first arm resonates in the same band as the second arm.

14. A planar inverted-F antenna comprising:

a RF connection feed point;

a short arm having an end coupled to the RF connection feed point;

a long arm having an end coupled to the RF connection feed point; and tuning circuitry selectively coupled to a distal end on the planar inverted-F antenna from the RF connection feed point.

15. The planar inverted-F antenna according to claim 14, further comprising a first ground connection point in close proximity to the RF connection feed point, the ground connection point selectively coupled to a ground.

16. The planar inverted-F antenna according to claim 14, wherein the tuning circuitry is coupled to an opposite end of the short arm from the RF connection feed point.

17. The planar inverted-F antenna according to claim 14, wherein the tuning circuitry is coupled to an opposite end of the long arm from the RF connection feed point.

18. The planar inverted-F antenna according to claim 14, wherein the tuning circuitry comprises a ground connection point.

19. The planar inverted-F antenna according to claim 14, wherein the tuning circuitry comprises an impedance.

20. The antenna assembly according to claim 14, wherein the short arm includes a section folded perpendicular to the short arm along the length of the short arm.

21. An antenna assembly for a mobile communication device, comprising:

a RF connection feed point;

a planar radiating element including a conductive area split by a nonconductive gap which divides the planar radiating element into a first arm having an end coupled to the RF connection feed point, and a second arm having an end coupled to the RF connection feed point; and a first connection point coupled to the opposite end of the first arm from the RF connection feed point, the first connection point being selectively coupled to a ground.

22. The antenna assembly according to claim 21, wherein the first arm includes a section folded substantially perpendicular to the first arm along the length of the first arm.

23. The antenna assembly according to claim 21, wherein the second arm includes a section folded perpendicular to the second arm along the length of the second arm.

* * * * *